US006186903B1

(12) United States Patent
Beebe et al.

(10) Patent No.: US 6,186,903 B1
(45) Date of Patent: Feb. 13, 2001

(54) GOLF CLUB HEAD WITH LOFT AND LIE ADJUSTMENT NOTCH

(75) Inventors: Lou C. Beebe; Daniel J. Kubica, both of Phoenix, AZ (US)

(73) Assignee: Karsten Manufacturing Corporation, Phoenix, AZ (US)

( * ) Notice: Under 35 U.S.C. 154(b), the term of this patent shall be extended for 0 days.

(21) Appl. No.: 09/346,452

(22) Filed: Jul. 1, 1999

(51) Int. Cl.[7] ..... A63B 53/02; A63B 53/06

(52) U.S. Cl. ..... 473/248; 473/305; 473/314; 473/350

(58) Field of Search ..... 473/244, 245, 473/246, 247, 248, 305, 306, 307, 308, 309, 310, 311, 312, 313, 314, 315, 324, 350, 349, 317, 327

(56) References Cited

U.S. PATENT DOCUMENTS 1,983,158 * 12/1934 Young .
2,067,556 * 1/1937 Wettlaufer .
2,363,991 * 11/1944 Reach .
3,191,936 * 6/1965 Guier .
3,909,005 * 9/1975 Piszel .
4,512,577 4/1985 Solheim .
4,948,132 * 8/1990 Wharton .
4,995,609 2/1991 Parente et al. .
5,165,688 * 11/1992 Schmidt .
5,230,510 7/1993 Duclos .
5,275,408 * 1/1994 Desbiolles .
5,584,770 * 12/1996 Jensen .
5,626,528 * 5/1997 Toulon .
5,873,790 * 2/1999 Yeh .

* cited by examiner

*Primary Examiner*—Sebastiano Passaniti
(74) *Attorney, Agent, or Firm*—Darrell F. Marquette

(57) ABSTRACT

A golf club head includes a front face arranged for impact with a golf ball, a heel portion and a toe portion. A hosel has a neck connected to the heel portion of the body. The hosel contains a bore for receiving one end of a golf club shaft, and the bore has a desired orientation relative to the body. The hosel neck has an upper surface and a lower surface, and a notch is formed in the lower surface of the hosel neck. The notch has a depth that varies along its length. A critical dimension measured between the upper surface of the hosel neck and a point on the depth of the notch is less than the outside diameter of the hosel. This permits the desired orientation of the bore to be adjusted by bending the hosel neck at the notch.

12 Claims, 4 Drawing Sheets

GOLF CLUB HEAD WITH LOFT AND LIE ADJUSTMENT NOTCH

BACKGROUND OF THE INVENTION

This invention relates generally to golf equipment and, in particular, to a golf club head with a notch for making loft and lie adjustments.

U.S. Pat. No. 4,512,577 to Karsten Solheim discloses an iron type golf club having a club head and a shaft. The club head includes a body, and a narrowed neck which connects the body to a hosel which receives the lower end of the shaft. The narrowed neck has a maximum dimension at its mid section that is smaller than the outside diameter of the hosel. When adjusting loft and lie angles of the club head, bending occurs at the narrowed neck. While the club head disclosed in the Solheim patent permits satisfactory loft and lie adjustments, it is recognized that further improvements are possible.

SUMMARY OF THE INVENTION

A golf club head according to an improvement includes a front face arranged for impact with a golf ball, a heel portion and a toe portion. A hosel having a neck connected to the heel portion of the body has an outside diameter. The hosel contains a bore for receiving one end of a golf club shaft having a longitudinal axis, and the bore has a desired orientation relative to the body. The hosel neck has an outer peripheral surface including an upper surface and a lower surface when viewed from a direction which is generally normal to the front face. A notch is formed only in the lower surface of the hosel neck and extends around only a portion of the hosel neck. The notch has a depth that varies along its length. A critical dimension measured between the upper surface of the hosel neck and a point on the depth of the notch is less than the outside diameter of the hosel so that the desired orientation of the bore relative to the body may be adjusted by bending the neck at the notch. The hosel has a top edge disposed at an acute angle to the shaft longitudinal axis when viewed in the direction which is generally normal to the front face.

DESCRIPTION OF THE PREFERRED EMBODIMENT

Figure 2:
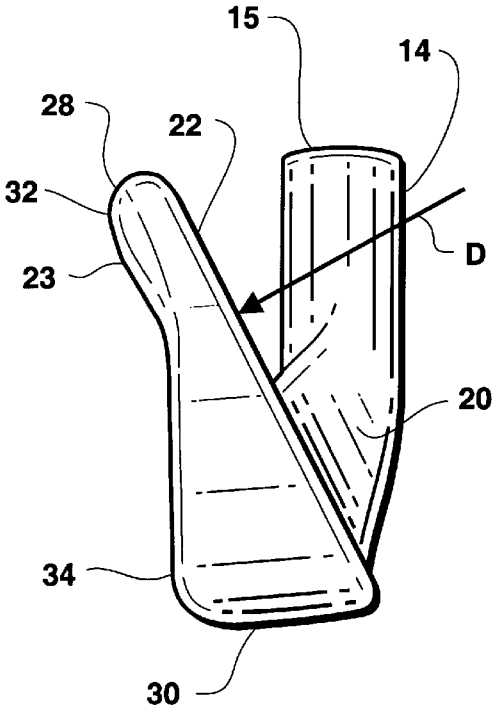
FIG. 2 is a toe end view of the golf club head of Fig. 1.
Figure 3:
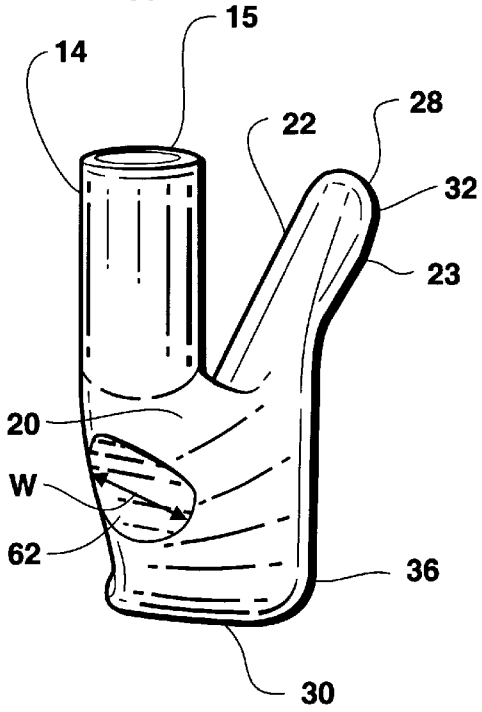
FIG. 3 is a heel end view of the golf club head of Fig. 1.
Figure 4:
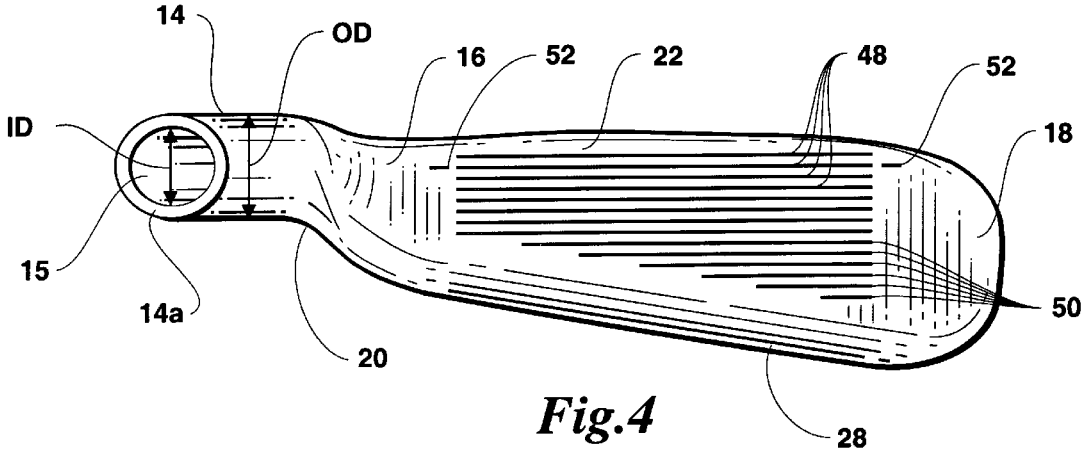
FIG. 4 is top view of the golf club head of FIG. 1.
Figure 5:
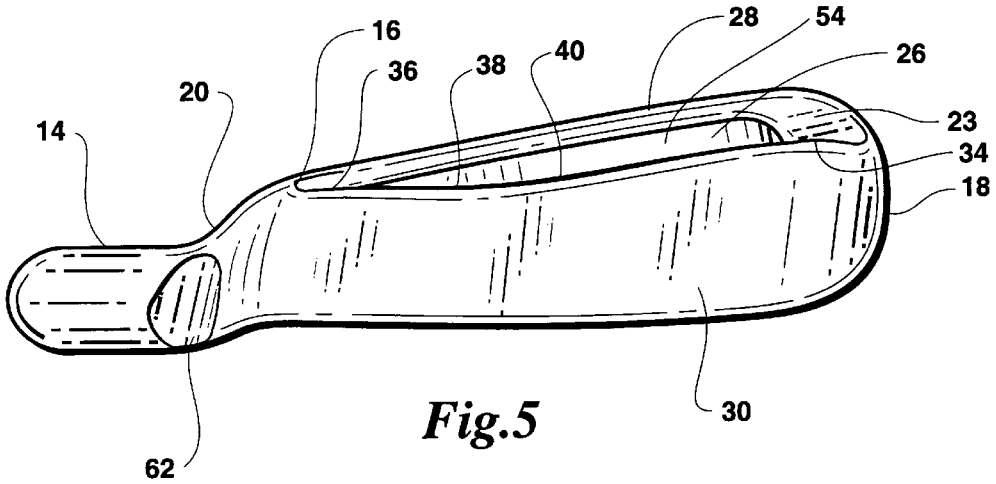
FIG. 5 is a bottom view of the golf club head of FIG. 1.
Figure 6:
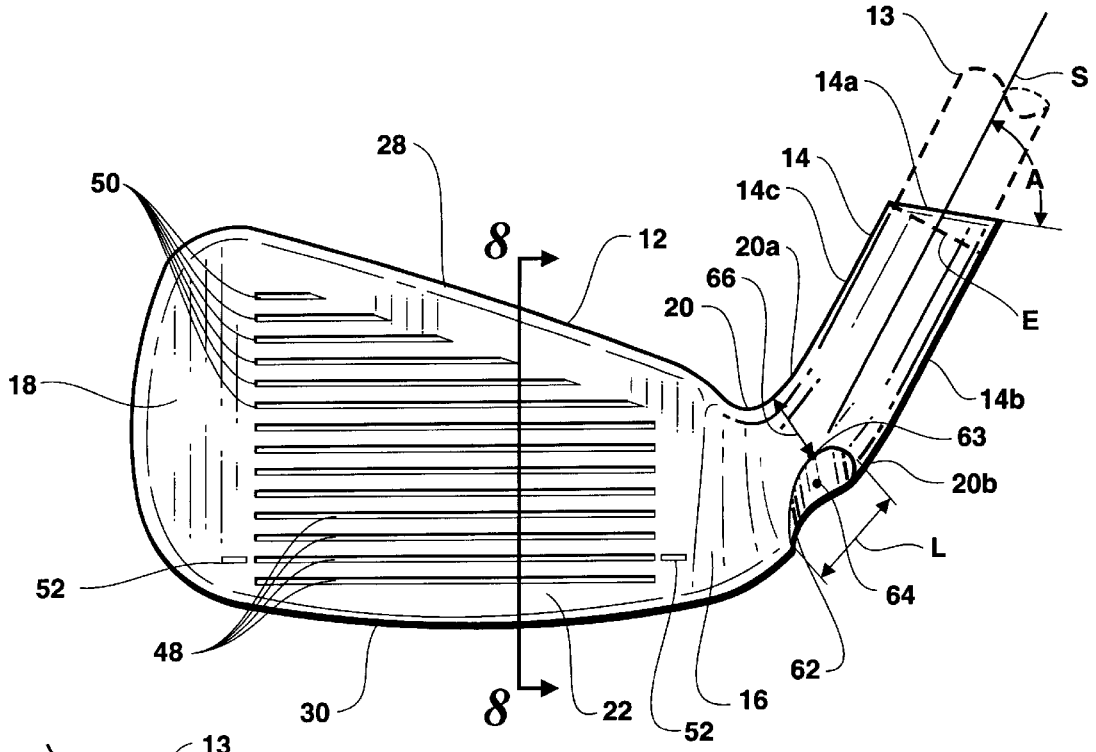
FIG. 6 is a front elevational view of the golf club head of FIG. 1.

Referring to FIGS. 1–7, an iron type golf club head 10 includes a body 12 and a hosel 14 containing a cylindrical bore 15 for receiving one end of a golf club shaft 13 (FIG. 6). The hosel 14 has an inside diameter ID and an outside diameter OD as best seen in FIG. 4. Although the club head 10 is shown as a five-iron, it could also be any iron-type club head from a one-iron to a wedge. The body 12 has a heel portion 16 and a toe portion 18 that are spaced apart. The hosel 14 includes a neck 20 connected to the heel portion 16 of the body 12. The club head 10 is preferably cast from suitable metal such as stainless steel. A front face 22 arranged for impact with a golf ball (not shown) is provided on the body 12 and extends between the body heel and toe portions 16, 18 along a frontal portion of the body 12. Disposed rearwardly of the front face 22 is a back face 23. When viewed as in FIG. 6 from a direction D (FIG. 2) which is generally normal to the front face 22, the outer peripheral surface of neck 20 includes an upper surface 20*a* and a lower surface 20*b*.

A perimeter weighting element 24 protrudes rearwardly from the front face 22 and defines a primary cavity 26 in the back face 23. The perimeter weighting element 24 includes a top rail 28 and a sole 30. The primary cavity 26 is defined at its upper extremity by the top rail 28 and at its lower extremity by the sole 30. The top rail 28 extends between the body heel and toe portions 16, 18 along an upper portion of the body 12, and the sole 30 extends between the body heel and toe portions 16, 18 along a lower portion of the body 12. The perimeter weighting element 24 also includes an upper toe weight 32 adjacent a toe end of the top rail 28, a lower toe weight 34 adjacent a toe end of the sole 30, and a lower heel weight 36 adjacent a heel end of the sole 30. The toe portion 18 of the body 12 has a back edge 19 that is indented toward the front face 22 between the top rail 28 and sole 30 separating the upper toe weight 32 from the lower toe weight 34.

The upper and lower toe weights 32, 34 and the lower heel weight 36 provide the club head 10 with resistance to twisting movement about a vertical axis through the body 12 as a result of the front face 22 impacting a golf ball near the heel portion 16 or the toe portion 18 of the body 12. The sole 30 has a lower trailing edge 38 that includes an indentation 40 (FIG. 5) between the lower heel and toe weights 34, 36 as described in U.S. Pat. No. 4,621,813 to Karsten Solheim. Located adjacent the lower trailing edge 38 of the sole 30 is a lower backsurface 42 of the perimeter weighting element 24. This lower backsurface 42 preferably slopes upwardly and inwardly from the trailing edge 38 toward the front face 22. The lower backsurface 42 merges with a lower inner surface 44 of the perimeter weighting element 24 along an upper trailing edge 46 of the sole 30. The indentation 40 and the sloping orientation of the lower backsurface 42 serve to redistribute material in the body 12 in a manner that increases the relative sizes of the lower heel and toe weights 34, 36 thereby increasing the resistance of the club head 10 to the above-mentioned twisting movement.

As seen in FIGS. 4 and 6, grooves 48, 50 are formed in the front face 22 of the body 12. The grooves 48, 50 are elongated in a direction extending between the heel and toe portions 16, 18 of the body 12 and include a set of grooves 48 of equal length and a set of grooves 50 of varying length. A pair of visual indicators 52 such as disclosed in U.S. Pat. No. 5,643,099 to J. A. Solheim may be provided on the front face 22.

The primary cavity 26 defined by the perimeter weighting element 24 has a bottom surface 54. Formed integrally on the primary cavity bottom surface 54 is an interior wall 56 that extends from a first end 56*a* located adjacent the body heel portion 16 through the primary cavity 26 between the top rail 28 and the sole 30 to a second end 56*b* located adjacent the body toe portion 18. The first and second ends

Figure 1:
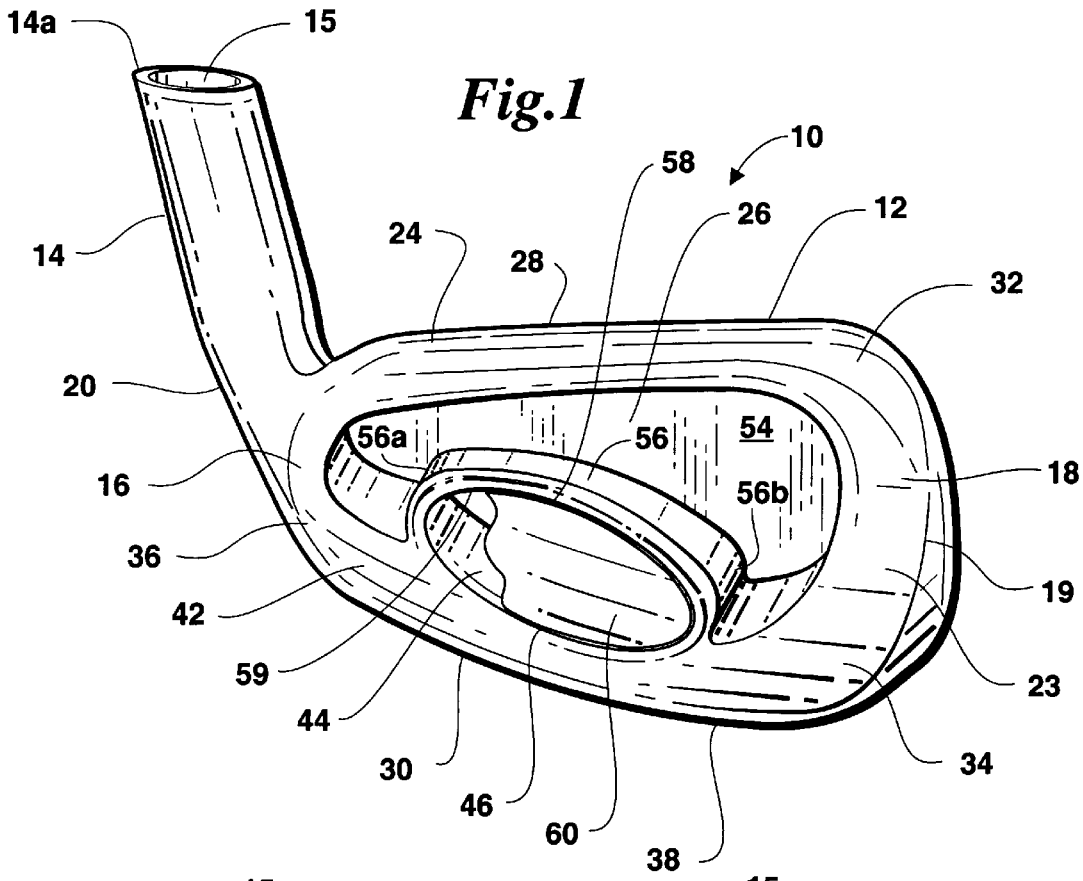
FIG. 1 is a perspective view of a golf club head embodying a loft and lie adjustment notch according to the present invention.
Figure 7:
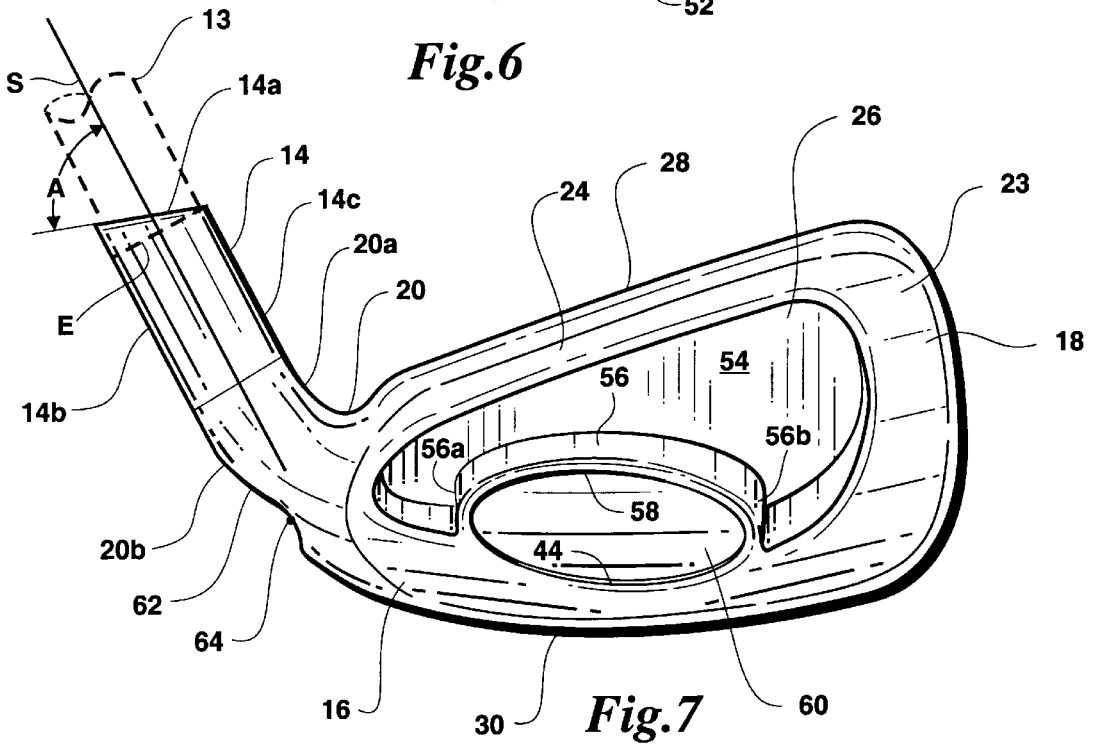
FIG. 7 is a rear elevational view of the golf club head of Fig. 1.
Figure 8:
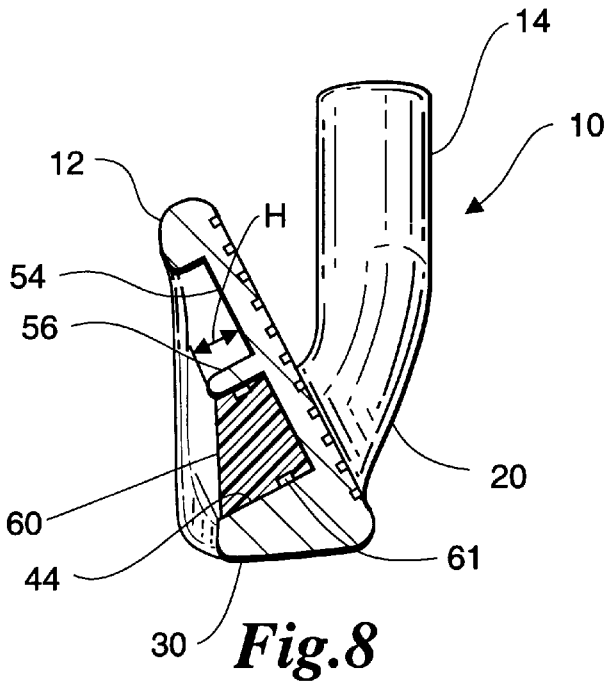
FIG. 8 is a sectional view taken along lines 8—8 in FIG. 6.

56*a,* 56*b* of the interior wall 56 are integrally connected to the perimeter weighting element 24 adjacent the body heel and toe portions 16, 18 defining a secondary cavity 58 within the primary cavity 26. The inner surface 44 of the perimeter weighting element 24 is disposed between the first and second ends 56*a,* 56*b* of the interior wall 56 and forms a lower extremity of the secondary cavity 58. An inner surface 59 of the interior wall 58 forms an upper extremity of the secondary cavity 58. The interior wall 56 has a height dimension H (FIG. 8) that varies between its first and second ends 56*a,* 56*b* as seen in FIGS. 1 and 7. It will be understood that the height dimension H of the interior wall 56 is greater at the second end 56*b* which is adjacent the body toe portion 18 than at the first end 56*a* which is adjacent the body heel portion 16.

A weight adjustment member 60 (partially broken away in FIG. 1) having a predetermined volume is disposed in the secondary cavity 58 and is secured therein by suitable adhesive such as epoxy. The weight adjustment member 60 is selected from a plurality of weight adjustment members (not shown) that have the same predetermined volume but have different densities and thus different weights. This plurality of weight adjustment members preferably covers a range from about four grams to about thirty grams in one gram increments. This range of weights should be sufficient to cover different shaft lengths and different types of shafts that may be attached to the club head 10. Therefore, the desired weight of the club head 10 may be adjusted without changing the predetermined volume of the weight adjustment member 60. By selecting a weight adjustment member 60 of proper weight, manufacturing tolerances can be overcome and the swingweight of a golf club may be adjusted. The weight adjustment member 60 is preferably formed of plastic. Since the weight adjustment member 60 is located near the center of gravity of the club head 10, the club head center of gravity will not change significantly when selecting any of the plurality of weight adjustment members.

Figure 9:
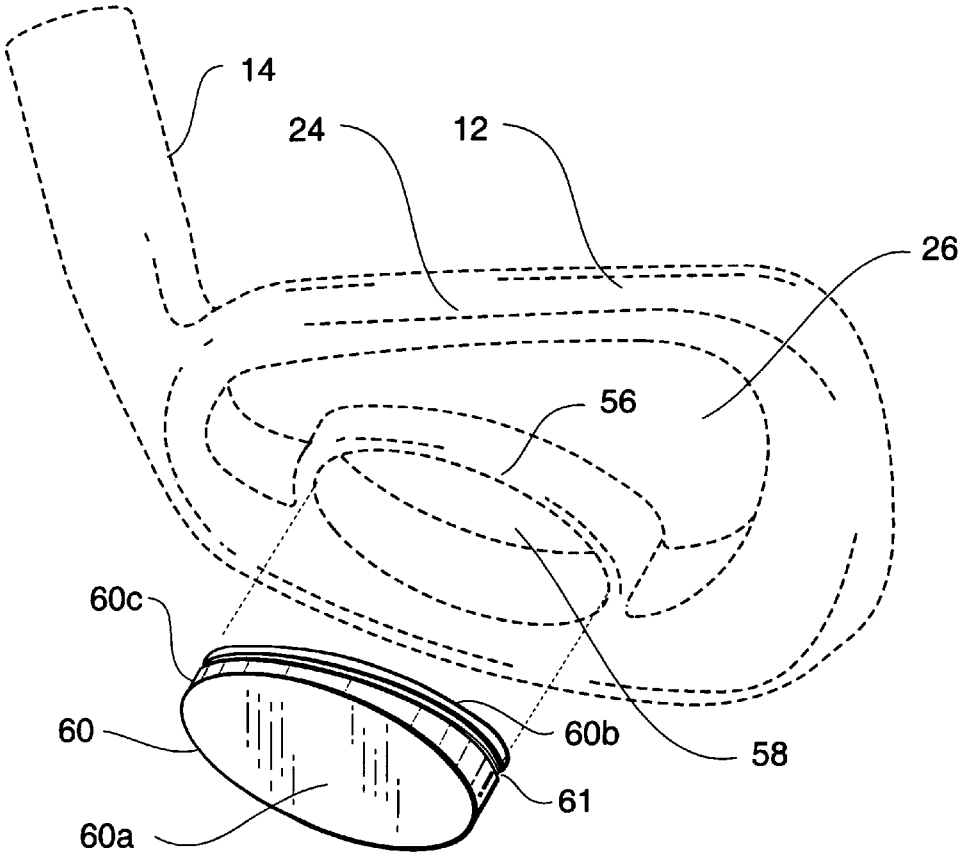
FIG. 9 is an exploded view of the golf club head of FIG. 1.

As shown in FIG. 9, the weight adjustment member 60 has a top surface 60*a,* a bottom surface 60*b,* and a side surface 60*c* extending between the top and bottom surfaces 60*a,* 60*b.* A groove 61 formed in the side surface 60*c* extends peripherally of the weight adjustment member 60. In order to secure the weight adjustment member 60 in the secondary cavity 58, epoxy is applied to the bottom surface 60*b* thereof Any excess epoxy collects in the groove 61 and is prevented from being pushed out of the secondary cavity 58.

In order to provide loft and lie adjustment of the club head 10, a notch 62 having a depth that varies along its length L is formed in the lower surface 20*b* of the neck 20. As seen in FIG. 3, the notch 62 has a maximum width dimension W that is substantially perpendicular to the front face 22. It will be understood that the maximum width dimension W of the notch 62 could be arranged at various angles to the front face 22 and, therefore, is not limited to being arranged as shown in FIG. 3. The notch 62 has a point of maximum depth 64 (FIGS. 6 and 7) preferably located on its maximum width dimension W. A critical dimension 66 (FIG. 6) measured between the upper surface 20*a* of the neck 20 and a point 63 on the depth of the notch 62 is less than the outside diameter OD of the hosel 14. This critical dimension 66 allows bending of the hosel 14 to occur only at the neck 20 with no bending of the portion of the hosel 14 containing the bore 15. The notch 62 may be positioned so that points 63 and 64 coincide if desired.

Referring to FIGS. 6 and 7, the hosel 14 has a top edge 14*a* that is disposed at an acute angle A of approximately 60 to 80 degrees with respect to the longitudinal axis S of the shaft 13 when viewed from the direction D (FIG. 2). This acute angle A significantly increases the cross sectional area of the shaft 13 at the top edge 14a of the hosel 14 thereby reducing shaft stress at the hosel top edge 14*a*. In a prior art club head such as shown in U.S. Pat. No. 4,512,577, the hosel 14 would have a top edge E that is perpendicular to the longitudinal axis S of the shaft 13. This prior art arrangement results in the smallest possible cross sectional area of the shaft 13 at the hosel top edge E, and consequently the highest shaft stress. Also, it will be understood that the hosel top edge 14*a* is oriented so that the hosel 14 has more mass on its heel side 14*b* than on its toe side 14*c*. This distribution of material in the hosel 14 increases the moment of inertia of the club head 10.

What is claimed is:

1. A golf club head of an iron-type comprising:

a body having a front face arranged for impact with a golf ball, a heel portion and a toe portion;

a hosel having an outside diameter and containing a bore for receiving one end of a golf club shaft, said bore having a desired orientation relative to said body, said hosel having a neck connected to said heel portion of said body, said hosel neck having an outer peripheral surface including an upper surface and a lower surface when viewed from a direction which is generally normal to said front face; and a notch formed only in the lower surface of said hosel neck and extending around only a portion of said hosel neck, said notch having a depth that varies along its length, a critical dimension measured between the upper surface of said hosel neck and a point on said depth of said notch being less than the outside diameter of said hosel whereby the desired orientation of said bore relative to said body may be adjusted by bending said neck at said notch.

2. The golf club head of claim 1, wherein said notch has a maximum width dimension and a point of maximum depth located on said maximum width dimension.

3. The golf club head of claim 2, wherein said maximum width dimension is substantially perpendicular to said front face.

4. The golf club head of claim 2, wherein said point on said depth of said notch coincides with said point of maximum depth.

5. The golf club head of claim 1, further comprising a perimeter weighting element protruding rearwardly from said front face, said perimeter weighting element including a top rail which extends between said body heel and toe portion along an upper portions of said body, said perimeter weighting element also including a sole which extends between said body heel and toe portions along a lower portion of said body.

6. The golf club head of claim 5, wherein said perimeter weighting element comprises an upper toe weight adjacent a toe end of said top rail, a lower toe weight adjacent a toe end of said sole, and a lower heel weight adjacent a heel end of said sole.

7. In a golf club head of an iron-type including a body having a front face arranged for impact with a golf ball, a heel portion, a toe portion, a hosel having an outside diameter and containing a bore for receiving one end of a golf club shaft, said bore having a desired orientation relative to said body, said hosel having a neck connected to said heel portion of said body, said hosel neck having an outer peripheral surface including an upper surface and a lower surface when viewed from a direction which is generally normal to said front face, the improvement comprising:

a notch formed only in the lower surface of said hosel neck and extending around only a portion of said hosel neck, said notch having a depth that varies along its length, a critical dimension measured between the upper surface of said hosel neck and a point on said depth of said notch being less than the outside diameter of said hosel whereby the desired orientation of said bore relative to said body may be adjusted by bending said neck at said notch.

8. In the golf club head of claim 7, wherein said notch has a maximum width dimension and a point of maximum depth located on said maximum width dimension.

9. In the golf club head of claim 7, further comprising a perimeter weighting element protruding rearwardly from said front face, said perimeter weighting element including a top rail which extends between said body heel and toe portions along an upper portion of said body, a sole which extends between said body heel and toe portions along a lower portion of said body, an upper toe weight adjacent a toe end of said top rail, a lower toe weight adjacent a toe end of said sole, and a lower heel weight adjacent a heel end of said sole.

10. A golf club head comprising:

a body having a front face arranged for impact with a golf ball, a heel portion and a toe portion;

a hosel having an outside diameter and containing a bore for receiving one end of a golf club shaft having a longitudinal axis, said bore having a desired orientation relative to said body, said hosel having a neck connected to said heel portion of said body, said hosel neck having an upper surface and a lower surface when viewed from a direction which is generally normal to said front face, said hosel having a top edge disposed at an acute angle to said shaft longitudinal axis when viewed in the direction which is normal to said front face; and a notch formed in the lower surface of said hosel neck, said notch having a depth that varies along its length, a critical dimension measured between the upper surface of said hosel neck and a point on said depth of said notch being less than the outside diameter of said hosel whereby the desired orientation of said bore relative to said body may be adjusted by bending said neck at said notch.

11. An a golf club head including a body having a front face arranged for impact with a golf ball, a heel portion, a toe portion, a hosel having an outside diameter and containing a bore for receiving one end of a golf club shaft having a longitudinal axis, said bore having a desired orientation relative to said body, said hosel having a neck connected to said heel portion of said body, said hosel neck having an upper surface and a lower surface when viewed from a direction which is generally normal to said front face, the improvement comprising:

a notch formed in the lower surface of said hosel neck, said notch having a depth that varies along its length, a critical dimension measured between the upper surface of said hosel neck and a point on said depth of said notch being less than the outside diameter of said hosel whereby the desired orientation of said bore relative to said body may be adjusted by bending said neck at said notch;

said hosel having a top edge disposed at an acute angle to said shaft longitudinal axis when viewed in the direction normal to said front face.

12. In the golf club head of claim 11, wherein said hosel top edge is oriented so that said hosel has more mass on a heel side than on a toe side thereof.

* * * * *